US005873312A

United States Patent [19]

Mauro-Vetter

[11] Patent Number: 5,873,312

[45] Date of Patent: Feb. 23, 1999

[54] ADJUSTABLE PARTS HOLDER

[75] Inventor: Timothy Mauro-Vetter, Davisburg, Mich.

[73] Assignee: DaimlerChrysler Corporation, Auburn Hills, Mich.

[21] Appl. No.: 934,432

[22] Filed: Sep. 19, 1997

[51] Int. Cl.[6] ..... A47B 9/00

[52] U.S. Cl. ..... 108/147.21; 248/161; 248/157

[58] Field of Search ..... 108/147.21, 144.11, 108/147.19, 147.15, 147.11; 248/161, 157; 297/423.38; 211/208, 205

[56] References Cited

U.S. PATENT DOCUMENTS

| | | | |
|---|---|---|---|
| Re. 33,645 | 7/1991 | Coote . | |
| 1,437,670 | 12/1922 | Mazoch | 108/147.21 |
| 2,644,688 | 7/1953 | Roberge . | |
| 2,857,227 | 10/1958 | Jacques | 108/147.21 X |
| 2,872,252 | 2/1959 | Konkle | 108/147.21 X |
| 2,917,104 | 12/1959 | Cottle | 297/423.38 X |
| 2,935,210 | 5/1960 | Cohen | 108/106 X |
| 3,027,209 | 3/1962 | Nielsen . | |
| 3,183,861 | 5/1965 | Halstick | 248/157 X |
| 4,119,044 | 10/1978 | Hines . | |
| 4,287,835 | 9/1981 | Stratton . | |
| 4,488,497 | 12/1984 | Bevans | 108/144.11 |
| 4,836,480 | 6/1989 | Besner | 248/161 X |
| 5,152,406 | 10/1992 | Kling et al. . | |
| 5,181,681 | 1/1993 | Edwards . | |
| 5,374,019 | 12/1994 | Fischer . | |

*Primary Examiner*—Jose V. Chen
*Attorney, Agent, or Firm*—Lawrence J. Shurupoff

[57] ABSTRACT

A parts holder comprises a tray and a vertically extensible and retractable support for supporting the tray in selected vertically adjusted positions. A brace in the form of a foot rest is secured to the support beneath the tray in selected vertically adjusted positions independently of the tray.

2 Claims, 2 Drawing Sheets

ADJUSTABLE PARTS HOLDER

FIELD OF INVENTION

This invention relates generally to parts holders and more particularly to a parts holder having a tray for holding the parts and also having a foot rest, both the tray and the foot rest being independently adjustable.

BACKGROUND OF THE INVENTION

Many small parts are used in the assembly line production of manufactured products, such as cars and trucks. The small parts are, for example, fasteners (screws, bolts, screw nails, etc.) mechanical parts and other items used in the construction of vehicles, and the like. These parts are supplied to assembly line operators at assembly work stations. An operator removes the parts from a supply tray and assembles the parts on a moving flow of vehicle or vehicle sub-assemblies. The tray is typically positioned to serve a worker of average height. However, a worker of other than average height may suffer fatigue after only a short period of time, because the tray is either too high or too low. It has also been discovered that a worker would like a foot rest so that he may change his position from time to time. What is needed is a parts holder having a tray and a foot rest, both of which are independently adjustable.

SUMMARY OF THE INVENTION

In accordance with the present invention, the parts holder comprises a tray, and a vertically extendable and retractable support for the tray to support the tray in selected vertically adjusted positions. The holder also has a brace or foot rest with means for securing it to the support beneath the tray in selected vertically adjusted positions independently of the tray.

More particularly, the support structure comprises a pair of laterally spaced legs each having telescoping members with means for locking the telescoping members in adjusted position. The brace or foot rest is secured to the legs in a vertically adjusted position beneath the tray. The tray and the foot rest are adjustable independently of one another so that the parts holder may be adapted to the preferences of each individual worker.

One object of this invention is to provide a parts holder having a tray and a foot rest, both of which are independently adjustable.

Another object is to provide a parts holder which is composed of a relatively few simple parts, is rugged and durable in use, and is capable of being easily and inexpensively manufactured and assembled.

These and other objects, features and advantages of the invention will become more apparent as the following description proceeds, especially when considered with the accompanying drawings.

DETAILED DESCRIPTION OF THE PREFERRED EMBODIMENT

Figure 1:
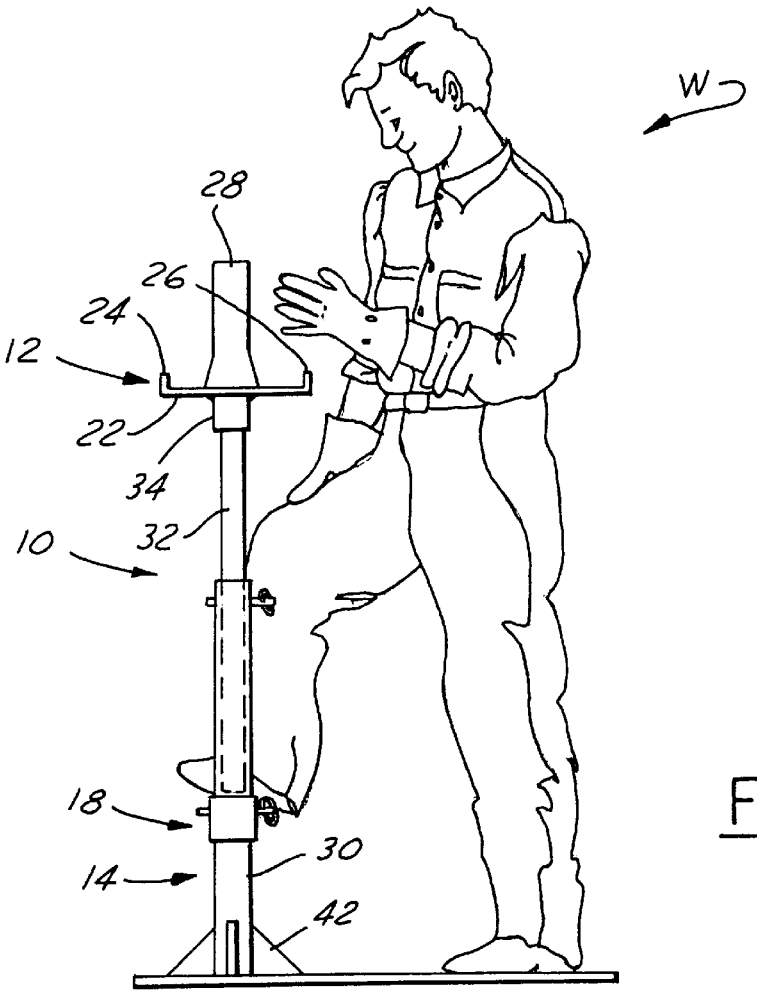
FIG. 1 is a side elevational view of a parts holder constructed in accordance with the invention and showing a worker standing nearby.
Figure 2:
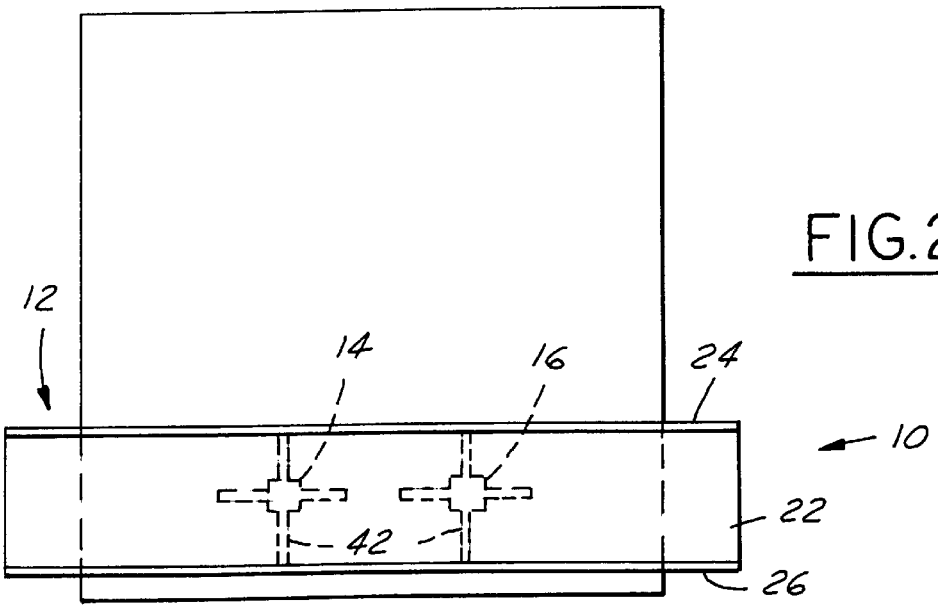
FIG. 2 is a top plan view of the structure shown in FIG. 1.
Figure 3:
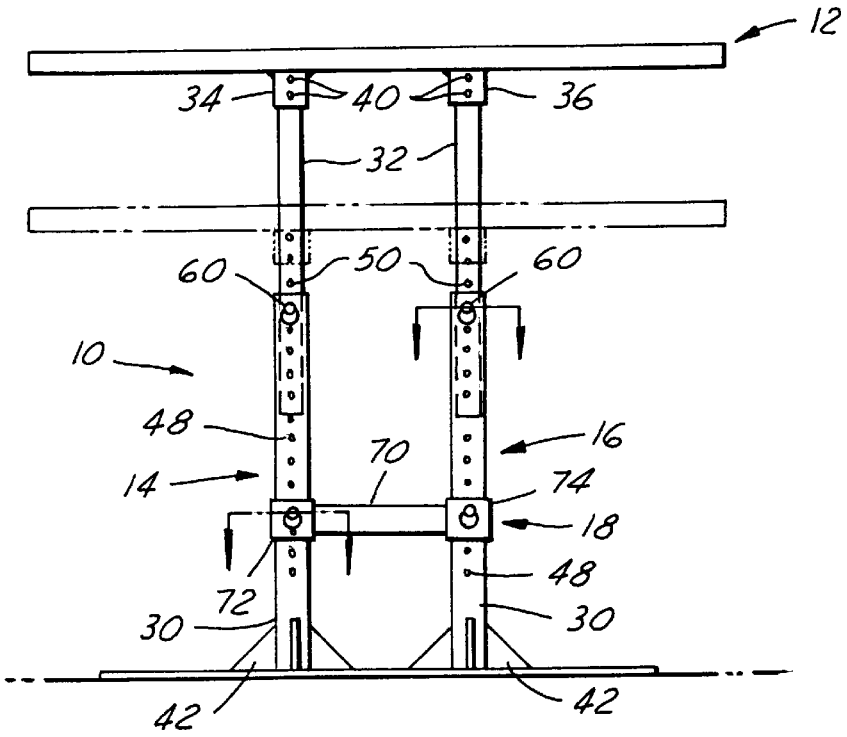
FIG. 3 is a front elevational view of the parts holder showing the tray in solid lines in an upper position and in broken lines in a lower position.
Figure 4:
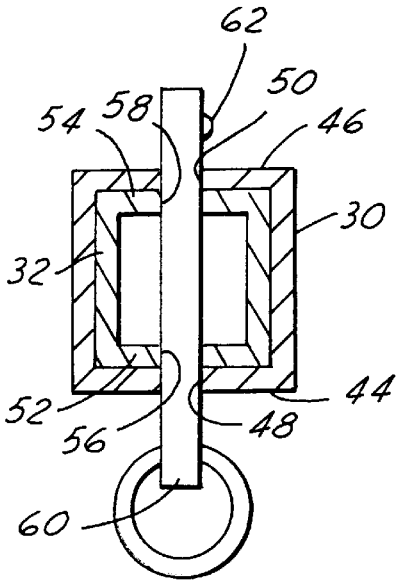
FIG. 4 is a sectional view taken on the line 4—4 in FIG. 3.
Figure 5:
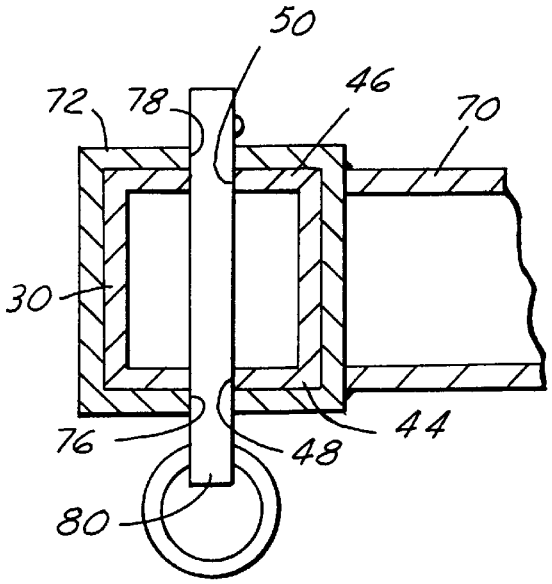
FIG. 5 is a sectional view taken on the line 5—5 in FIG. 3.

Referring now more particularly to the drawings, the parts holder 10 comprises a tray 12 supported on the upper ends of a pair of laterally spaced elongated legs 14 and 16, and a brace 18 extending between and secured to the legs beneath the tray.

The tray 12 is in the form of an elongated upwardly opening channel having a horizontal bottom wall 22 and laterally spaced, vertical upwardly extending side walls 24 and 26. Small parts 28 used in the construction of a moving flow of products, such as automotive vehicles, may be supported on the tray.

The legs 14 and 16 are identical and provide a vertically extensible and retractable support for the tray. Each leg is vertical and has an elongated lower tubular member 30 of square cross-section and an elongated upper tubular member 32 of square cross-section slidably telescoped within the lower member 30. Tube segments 34 and 36 are secured to the lower surface of the bottom wall 22 of the tray 12 in longitudinally spaced-apart relation and are sleeved over the upper ends of the upper telescoping members 32 of the legs. The tube segments 34 and 36 are secured to the upper ends of the upper telescoping members 32 of the legs by fasteners 40.

The lower telescoping member 30 of each vertical leg has four braces 42 fixed to a pad 43 for supporting the parts holder on the floor or other supporting surface. The lower telescoping member 30 of each vertical leg has a front wall 44 and a back wall 46. The front wall 44 has a series of equally longitudinally spaced-apart holes 48. The back wall 46 has a series of equally longitudinally spaced-apart holes 50 respectively aligned or paired with the holes 48 in the front wall.

The upper telescoping member 32 of each vertical leg has a front wall 52 and a back wall 54. The front wall 52 has a series of equally longitudinally spaced-apart holes 56. The back wall 54 has a series of equally longitudinally spaced-apart holes 58 respectively aligned or paired with the holes 56 in the front wall 52. The paired holes 48 and 50 in the lower telescoping member 30 of each leg are spaced apart the same distance as the paired holes 56 and 58 in the upper telescoping member 32. Any of the paired holes of the upper telescoping member may be aligned with any of the paired holes of the lower telescoping member to adjust the height of the tray 12.

A pull pin 60 may be extended through the paired holes 56 and 58 of the upper telescoping member 32 and the aligned paired holes 48 and 50 of the lower telescoping member 30 to releasably secure the upper and lower telescoping members of the legs in longitudinally adjusted position. The height of the tray 12 may be easily raised or lowered by removing the pull pin 60, extending or retracting the upper telescoping member 32, and reinserting the pull pin in a new set of aligned holes. The pull pin 60 is of conventional construction having a spring pressed ball 62 for releasably retaining the pull pin after it is inserted.

The brace 18 strengthens the legs and serves as a foot rest. The brace or foot rest comprises an elongated horizontal bar 70 having square tube segments 72 and 74 secured to the opposite ends. The tube segments 72 and 74 are sleeved over the lower telescoping members 30 of the respective legs 14 and 16 and each have aligned holes 76 and 78 in the front and back walls thereof. The foot rest may be raised or lowered to align the holes 76,78 of the tube segments 72,74 with any of the holes 48,50 in the lower telescoping members 30 of the legs. A pull pin 80, similar to pull pin 60, may be inserted in the aligned holes to lock the tube segments, and hence the foot rest, in vertically adjusted position. The foot rest 18 may be easily adjusted by removing the pull pin 80, raising or lowering the foot rest, and reinserting the pull pin in a new set of aligned holes. A worker W is shown in FIG. 1 taking parts 28 from the tray 12, with one foot on the foot rest 18.

Thus, it will be seen that the tray and the foot rest are independently adjustable, for the convenience and comfort of the operator.

What is claimed is:

1. A parts holder comprising;

an elongated, rectangular tray, a vertically adjustable, two legged support for the tray comprising a pair of vertical, elongated legs spaced apart lengthwise of the tray and constituting the sole support for said tray, each of said legs comprising an elongated, vertical, lower member and an elongated, vertical, upper member telescoped one within the other, means for releaseably securing the upper and lower members of each of said legs together in vertically adjusted position comprising longitudinally spaced holes in the upper and lower members thereof in positions for selective registration with one another, and a pull pin for each of said legs extending through selected registering holes of the upper and lower members thereof, means securing said tray to the tops of the upper members, a brace comprising a horizontal bar adapted to serve as a foot rest and having tube segments on opposite ends of the bar sleeved on the lower members of said respective legs, and means securing said brace to the lower members of said respective legs comprising holes in said tube segments adapted to register with selected holes in said lower members, and a pull pin for each of said tube segments extending through the hole therein and through a registering selected hole in the associated lower member.

2. A parts holder as in claim 1, wherein said tray has an elongated horizontal bottom wall and laterally spaced, upwardly extending, parallel side walls extending lengthwise of said tray along opposite sides thereof, the tops of said upper members are secured to the bottom wall of said tray at points midway between said opposite sides of said tray, and said horizontal bar is accessible for use as a foot rest by an operator of the parts holder positioned at either side of the tray.

* * * * *